US008562307B2

(12) United States Patent
Shimazaki et al.

(10) Patent No.: US 8,562,307 B2
(45) Date of Patent: Oct. 22, 2013

(54) PUMP EQUIPMENT

(75) Inventors: Hirobumi Shimazaki, Kobe (JP); Ryosuke Kusumoto, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 788 days.

(21) Appl. No.: 12/162,117

(22) PCT Filed: Sep. 13, 2006

(86) PCT No.: PCT/JP2006/318162

§ 371 (c)(1),
(2), (4) Date: May 26, 2009

(87) PCT Pub. No.: WO2007/086165

PCT Pub. Date: Aug. 2, 2007

(65) Prior Publication Data

US 2009/0304528 A1 Dec. 10, 2009

(30) Foreign Application Priority Data

Jan. 26, 2006 (JP) ..... 2006-018124

(51) Int. Cl.
*F04B 49/00* (2006.01)

(52) U.S. Cl.
USPC ..... 417/212; 91/505; 417/274; 417/277

(58) Field of Classification Search
USPC ..... 417/211.5, 274, 212–223, 277; 91/505
See application file for complete search history.

(56) References Cited

U.S. PATENT DOCUMENTS

2003/0198559 A1* 10/2003 Worthington ..... 417/286
2006/0090639 A1* 5/2006 Dong et al. ..... 91/505

FOREIGN PATENT DOCUMENTS

JP 03-138469 6/1991
JP 10-281073 10/1998
JP 2001-254681 9/2001

OTHER PUBLICATIONS

International Search Report for PCT/JP2006/318162, dated Nov. 28, 2006.
Extended European Search Report for EP Application No. 06797912.0, dated Jun. 22, 2011.

* cited by examiner

*Primary Examiner* — Nimeshkumar Patel
*Assistant Examiner* — Jacob R Stern

(57) ABSTRACT

An electrical signal input type displacement control device capable of reducing pipes on hydraulic equipment, and hydraulic equipment including the same. The pump equipment includes two the pump units. Electrical regulators are disposed for the pump units. In each of the electrical regulators, a solenoid proportional valve changes a supply status of driving oil. A pilot piston activates a servo switching valve in accordance with a supply status of the supplied driving oil, and controls a supply status of mechanism driving oil supplied to a servo mechanism. Servo mechanisms change the capacities of the pump units in accordance with the supply status. In the electrical regulators, a driving oil passage connects the input port to an inter-pump passage.

1 Claim, 5 Drawing Sheets

PUMP EQUIPMENT

TECHNICAL FIELD

The present invention relates to an electrical signal input type displacement control device which changes a capacity of a variable displacement type hydraulic apparatus, such as an axial pump, in accordance with an electrical signal input thereto, and a hydraulic equipment including the same.

BACKGROUND ART

In recent years, a hydraulic equipment including a plurality of swash plate type piston pumps has been put to practical use. As a regulator for changing the capacity of each swash plate type piston pump included in the hydraulic equipment, an electrical regulator and a hydraulic regulator are used.

FIG. 5 is a hydraulic circuit diagram showing a hydraulic circuit of a pump equipment 2 including electrical regulators 1 of a first prior art. The pump equipment 2 includes a pump apparatus 4 having two swash plate type piston pumps 3, and two electrical regulators 1. The pump apparatus 4 is a tandem pump in which two variable displacement type swash plate type piston pumps 3 are disposed in parallel with each other in an axial direction. Each swash plate type piston pump 3 is a variable displacement type piston pump capable of changing a capacity thereof in accordance with an inclination angle of a swash plate 5. The electrical regulator 1 is a regulator which is disposed for each swash plate type piston pump 3 and changes the capacity of the swash plate type piston pump 3 in accordance with an electrical signal input thereto.

For each swash plate type piston pump 3, a servo mechanism 6 is disposed to change the capacity of the swash plate type piston pump 3. Each servo mechanism 6 includes a servo piston 7. The servo mechanism 6 activates the servo piston 7 in accordance with the pressure of a mechanism driving oil supplied to the servo mechanism 6 to incline the swash plate 5 and to thereby change the inclination angle of the swash plate 5. Thus, the servo mechanism 6 changes the capacity of the swash plate type piston pump 3.

The electrical regulator 1 basically includes a servo switching valve 8, an electrical control type pilot piston 9 and a solenoid valve 10. The servo switching valve 8 includes a spool 11 and a sleeve 12. The electrical regulator 1 is configured to be able to receive pilot oil for activating the electrical control type pilot piston 9. The electrical control type pilot piston 9 is disposed to be able to receive the pressure of the pilot oil. The electrical control type pilot piston 9 displaces the spool in accordance with the pressure of the pilot oil to change a supply status of the mechanism driving oil supplied to the servo mechanism 6, thus changing the capacity of the swash plate type piston pump 3. The sleeve 12 is coupled to the servo piston 6 via a connecting rod 13 and controls the supply status of the mechanism driving oil based on the inclination angle of the swash plate 5, thus changing the capacity of the swash plate type piston pump 3. The solenoid valve 10 is configured to be able to change a connection status of an output port 14 thereof and a connection status of an input port 15 thereof in accordance with an electrical signal input thereto. The solenoid valve 10 changes the supply status of the pilot oil, having been supplied to the input port 15, with respect to the electrical control type pilot piston 9. A pipe for directing the pilot oil from a hydraulic supply source to the input port 15 of the solenoid valve 10 is formed for each electrical regulator 1 (see Patent Document 1 for example).

A hydraulic equipment of a second prior art includes a pump apparatus having two swash plate type piston pumps, and two hydraulic regulators. As with the first prior art, the pump apparatus is a tandem pump in which two swash plate type piston pumps are disposed in parallel with each other in an axial direction. For each swash plate type piston pump, a servo mechanism is disposed. The hydraulic regulator is a regulator which is disposed for each swash plate type piston pump and changes the capacity of the swash plate type piston pump in accordance with a hydraulic signal input to the hydraulic regulator, that is, the pressure of the pilot oil supplied to the hydraulic regulator. As with the electrical regulator, the hydraulic regulator basically includes a servo switching valve, and further includes a hydraulic control type pilot piston and a power control piston.

The hydraulic regulator is configured to be able to receive the pilot oil for activating the hydraulic control type pilot piston. The hydraulic control type pilot piston displaces the spool in accordance with the pressure of the pilot oil supplied to the hydraulic regulator and changes the supply status of the mechanism driving oil supplied to the servo mechanism. The power control piston is disposed to be able to receive the pressure of the hydraulic oil discharged from the swash plate type piston pump. The power control piston displaces the spool in accordance with the pressure of the hydraulic oil discharged from the swash plate type piston pump to change the capacity of each of two swash plate type piston pumps. Further, the power control piston is disposed to be able to receive the pressure of power control piston driving oil supplied thereto. The power control piston can displace the spool in accordance with the pressure of the power control piston driving oil to change the capacity of the swash plate type piston pump, thus changing a maximum power of the hydraulic oil discharged. Formed in the pump apparatus of the pump equipment is an inter-pump passage for directing the power control piston driving oil from the power control piston of one of the hydraulic regulators to the power control piston of another hydraulic regulator. With this, the pump equipment can supply the power control piston driving oil from one hydraulic supply source to respective power control pistons.

Patent Document 1: Japanese Patent Publication No. 3080597 (page 6, FIG. 16)

DISCLOSURE OF THE INVENTION

Problems to be Solved by the Invention

In the pump equipment 2 of the first prior art, the pilot oil is supplied from the hydraulic supply source to the input ports 15 of the solenoid valves 10 to activate the electrical regulators 1. Therefore, in the case of using the pump equipment 2, a plurality of pipes 17 are disposed to connect the input ports of the electrical regulators 1 to the hydraulic supply source. On this account, the number of components is large, and the number of steps of an assembling operation is large, so that work efficiency of the assembling operation deteriorates. Moreover, since a plurality of pipes 17 are required, an occupied space of the pump equipment 2 becomes large.

In the pump equipment of the second prior art, the pump apparatus includes the inter-pump passage extending over two swash plate type piston pumps. The inter-pump passage is formed to direct the power control piston driving oil, having been supplied to the power control piston of one of the hydraulic regulators from the hydraulic supply source, to another hydraulic regulator. In the hydraulic equipment, the inter-pump passage is used to supply the power control piston driving oil to the hydraulic regulators disposed for respective swash plate type piston pumps.

For each swash plate type piston pump included in the pump equipment of the second prior art, the electrical regulator 1 of the first prior art can be used instead of the hydraulic regulator. In the case of using the electrical regulator 1 in the pump equipment, the inter-pump passage of the pump apparatus is not used and wasted. In the case of using the electrical regulator instead of the hydraulic regulator, the inter-pump passage of the pump apparatus is not used effectively, so that the cost effectiveness of the equipment is low.

An object of the present invention is to provide an electrical signal input type displacement control device capable of reducing pipes to be disposed in a hydraulic equipment, and a hydraulic equipment including the same.

Another object of the present invention is to provide an electrical signal input type displacement control device capable of effectively utilizing a passage formed in a hydraulic equipment, and a hydraulic equipment including the same.

Means for Solving the Problems

The present invention is an electrical signal input type displacement control device of each of a plurality of variable displacement type hydraulic apparatuses equipped in a hydraulic equipment, comprising: a mechanism control valve which controls a supply status of a mechanism driving fluid supplied to a capacity changing mechanism provided in each of the plurality of variable displacement type hydraulic apparatuses to activate the capacity changing mechanism and which controls the supply status of the mechanism driving fluid supplied to the capacity changing mechanism in accordance with a supply status of a valve driving fluid supplied to the mechanism control valve; a solenoid valve which changes the supply status of the valve driving fluid, having been supplied to an input port thereof, with respect to the mechanism control valve in accordance with an electrical signal input thereto; and a valve driving fluid passage which connects the input port to a hydraulic apparatus passage extending between the plurality of variable displacement type hydraulic apparatuses.

Moreover, the present invention has such a feature that in a case of using hydraulic signal input type displacement control devices each of which activates the capacity changing mechanism in accordance with an input of a hydraulic signal instead of using electrical signal input type displacement control devices, the hydraulic apparatus passage directs a fluid pressure, used for controlling a capacity of the hydraulic apparatus, from one of the hydraulic signal input type displacement control devices to another hydraulic signal input type displacement control device.

Moreover, the present invention is a hydraulic equipment comprising: a plurality of hydraulic apparatuses; and the electrical signal input type displacement control device disposed for each of the plurality of hydraulic apparatuses.

Effects of the Invention

According to the present invention, the solenoid valve changes the supply status of the valve driving fluid supplied to the mechanism control valve in accordance with an electrical signal input thereto. The mechanism control valve controls the supply status of the mechanism driving fluid supplied to the capacity changing mechanism in accordance with the supply status of the driving fluid supplied to the mechanism control valve, and activates the capacity changing mechanism. By activating the capacity changing mechanism, it is possible to change the capacities of the hydraulic apparatuses equipped in the hydraulic equipment. The hydraulic apparatus passage extending between the hydraulic apparatuses and the valve driving fluid passage are connected to each other. Therefore, by supplying the valve driving fluid to at least one of a plurality of solenoid valves, the valve driving fluid is supplied to the input ports of the solenoid valves. With this, it is unnecessary to additionally form a pipe for supplying the valve driving fluid for each input port of the solenoid valve. On this account, in the case of disposing the hydraulic equipment, it is possible to reduce the pipes of the hydraulic equipment. Thus, it is possible to reduce the space necessary for disposing the pipes as compared with the second prior art. With this, it is possible to reduce the occupied space of the hydraulic equipment. Since it is possible to omit steps of disposing the pipes when mounting the hydraulic equipment on, for example, an industrial machinery, it is possible to reduce the number of operation steps.

According to the present invention, in the case of using the hydraulic signal input type displacement control devices instead of the electrical signal input type displacement control devices, the hydraulic apparatus passage of the hydraulic apparatuses is used to direct the fluid pressure, used to control the capacity of the hydraulic apparatus, from one of the hydraulic signal input type displacement control devices to another hydraulic signal input type displacement control device. The hydraulic apparatus passage is not used in the case of using the electrical regulator that is the electrical signal input type displacement control device of the prior art. By using the hydraulic apparatus passage in the case of using the electrical signal input type displacement control device, it is possible to effectively utilize the hydraulic apparatus passage of the hydraulic apparatuses. Moreover, in the hydraulic equipment including a plurality of hydraulic apparatuses each of which can activate the capacity changing mechanism by the hydraulic signal input type displacement control device, it is unnecessary to additionally form the hydraulic apparatus passage, and it is possible to omit steps of forming the hydraulic apparatus passage. If the hydraulic signal input type displacement control device can be disposed in a hydraulic apparatus, the electrical signal input type displacement control device can be disposed in the hydraulic apparatus without additionally forming the hydraulic apparatus passage, and is high in versatility.

According to the present invention, by supplying the valve driving fluid to the electrical signal input type displacement control device attached to at least one of the hydraulic apparatuses, it is possible to change the capacities of the hydraulic apparatuses in accordance with an electrical signal input to each of the electrical signal input type displacement control devices. With this, it is unnecessary to additionally form a pipe for supplying the valve driving fluid for each input port of the solenoid valve. On this account, in the case of disposing the hydraulic equipment, it is possible to reduce the pipes of the hydraulic equipment. Thus, it is possible to reduce the space necessary for disposing the pipes as compared with the second prior art. With this, it is possible to reduce the occupied space of the hydraulic equipment in an industrial machinery and construction machinery. Since the existing hydraulic apparatus passage can be effectively utilized, the cost effectiveness of the equipment can be improved.

EXPLANATION OF REFERENCE NUMBERS

Figure 1:
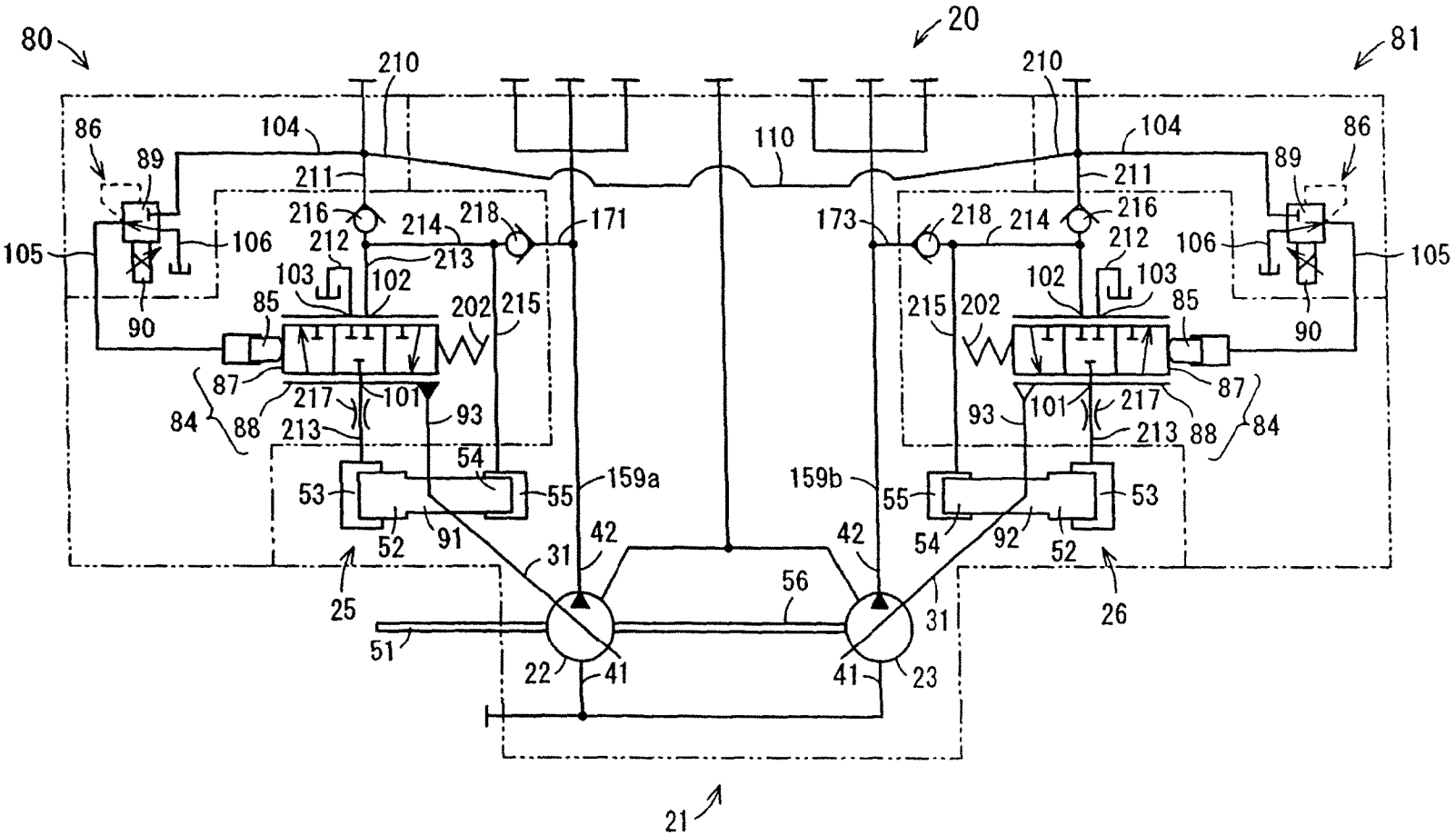
FIG. 1 is a hydraulic circuit diagram showing a hydraulic circuit of a pump equipment 20 of an embodiment of the present invention.

20 pump equipment
21 pump apparatus
22, 23 pump unit
25, 26 servo mechanism
80, 81 electrical regulator
84 servo switching valve
85 pilot piston
86 solenoid proportional valve
104 input port
110 inter-pump passage
111, 112 hydraulic regulator
210 driving oil passage

BEST MODE FOR CARRYING OUT THE INVENTION

Hereinafter, a plurality of embodiments for carrying out the present invention will be explained in reference to the drawings. In respective embodiments, same reference numbers may be used for members corresponding to members explained in preceding embodiments, and a repetition of the same explanation may be avoided. If only a part of components of a configuration are explained in an embodiment, the other components of the configuration are the same as those in preceding embodiments. Not only combining components specifically explained in respective embodiments but also partially combining embodiments may be carried out as long as the combination does not cause any problem.

FIG. 1 is a hydraulic circuit diagram showing a hydraulic circuit of a pump equipment 20 of an embodiment of the present invention. The pump equipment 20 that is a hydraulic equipment is mounted on, for example, industrial machineries and construction machineries that are mounting targets, and supplies a hydraulic fluid to respective actuators of the mounting target. The pump equipment 20 includes a combined pump apparatus called, for example, a tandem pump in which two pumps are combined. However, the combined pump apparatus is not limited to an apparatus in which two pumps are combined, and may be an apparatus in which three or more pumps are combined. The above two combined pumps are variable displacement type piston pumps, and are swash plate type piston pumps in the present embodiment. In the pump equipment 20, electrical regulators 80 and 81 are further equipped for respective pumps to change the capacities of the pumps. Each of the electrical regulators 80 and 81 that are the electrical signal input type displacement control devices changes the capacity of the pump based on an electrical signal input thereto.

The pump equipment 20 includes a pump apparatus 21 having first and second pump units 22 and 23, a valve unit 24 and first and second servo mechanisms 25 and 26, and first and second electrical regulators 80 and 81. The pump units 22 and 23 that are hydraulic apparatuses, and the valve unit 24 are disposed coaxially, and axes of the pump units 22 and 23 and the valve unit 24 form an axis L21 of the pump apparatus 21. The pump units 22 and 23 and the valve unit 24 are arranged along the axis L21 of the pump apparatus 21 and are coupled to one another such that the valve unit 24 is sandwiched between the pump units 22 and 23. The servo mechanisms 25 and 26 that are capacity changing mechanisms are disposed for the pump units 22 and 23, respectively. The electrical regulators 80 and 81 are disposed above the pump units 22 and 23, respectively, and are coupled to the pump units 22 and 23, respectively.

The pump units 22 and 23 include pump casings 27 and 28, respectively. Each of the pump units 22 and 23 is configured to include components, such as a cylinder block, a piston, a swash plate 31, etc., which are stored in each of the pump casings 27 and 28. The valve unit 24 includes a valve casing 30. The valve unit 24 is configured to include in the valve casing 30 first and second valve plates which are slidable with respect to the cylinder blocks of the pump units 22 and 23, respectively. The valve casing 30 and the valve plates may be formed integrally or separately. The servo mechanisms 25 and 26 include servo pistons 91 and 92, respectively. The servo mechanisms 25 and 26 are configured such that the pump casings 27 and 28 store, at their upper portions, the servo pistons 91 and 92, respectively, which incline the swash plates 31, respectively.

The first pump unit 22 includes a rotational shaft 51. The rotational shaft 51 is rotatably supported by the pump casings 27 and 28 via bearings. The cylinder blocks are disposed on the rotational shaft 51 so as not to rotate with respect to the rotational shaft 51. In the cylinder block, a plurality of piston chambers are formed. In each piston chamber, a piston partially fits so as to be able to carry out a reciprocating displacement. Each piston has an end portion which projects from the cylinder block and is in contact with a supporting surface of the swash plate 31 via a shoe, and displaces along the supporting surface of the swash plate 31. The supporting surface of the swash plate 31 inclines with respect to a virtual flat surface perpendicular to the rotational shaft. With the rotation of the cylinder block, each piston carries out the reciprocating displacement in an extending direction and retracting direction.

The first valve plate includes an inlet port 41 connected to, for example, a tank that is an oil source in which hydraulic oil that is a hydraulic fluid is stored and an outlet port 42 connected to an actuator to which the hydraulic oil is supplied. The valve plate is disposed such that the inlet port 41 is connected to the piston chamber in which the piston in an extending stroke in which the piston displaces in the extending direction fits, and the outlet port 42 is connected to the piston chamber in which the piston in a retracting stroke in which the piston displaces in the retracting direction fits. With this, when driving power is transferred from a power unit to the rotational shaft 51 to rotate the cylinder block, the hydraulic oil is suctioned from the tank by the reciprocating displacement of each piston so as to be supplied to the actuator.

The servo piston 91 of the first servo mechanism 25 disposed for the first pump unit 22 is stored in the pump casing 27 so as to be able to carry out the reciprocating displacement. A first axial end portion 52 of the servo piston 91 and the pump casing 27 form a first oil chamber 53, and a second axial end portion 54 of the servo piston 91 and the pump casing 27 form a second oil chamber 55. The first oil chamber 53 and the second oil chamber 55 are configured to be able to receive oil that is a hydraulic fluid. The servo piston 91 inclines the swash plate 31 of the first pump unit 22 to change the inclination angle of the supporting surface of the swash plate 31 in accordance with the pressure of the oil supplied to the first oil chamber 53 and the second oil chamber 55. Thus, the capacity of the pump can be changed. The first the servo mechanism 25 is formed by the servo piston 91 and inner walls of the pump casings 27 and 28 forming the first oil chamber 53 and the second oil chamber 55. Thus, the first pump unit 22, the first servo mechanism 25, and part of components including the first valve plate of the valve unit 24 form one pump.

The second pump unit 23 has substantially the same configuration as the first pump unit 22, and the second servo mechanism 26 has substantially the same configuration as the first the servo mechanism 25. Thus, the second pump unit 23, the second servo mechanism 26, and part of components including the second valve plate of the valve unit 24 form the other pump. This pump has substantially the same configuration as the above-described pump realized by the first pump unit 22, the first the servo mechanism 25 disposed for the first pump unit 22, and part of components including the first valve plate of the valve unit 24. In the second pump unit 23 and the second servo mechanism 26, same reference numbers are used for members having the same configurations as the members in the first pump unit 22 and the first the servo mechanism 25, and explanations thereof are omitted.

These pumps have the same configurations as each other except for the rotational shaft 51 and a rotational shaft 56. The rotational shaft 51 of the first pump unit 22 projects from the pump casing 27 and receives the power from the power unit. The rotational shaft 56 of the second pump unit 23 is coupled, in the valve unit 24, to the rotational shaft 51 of the pump including the first pump unit 22. With this, these two pumps operate in association with each other.

The first electrical regulator 80 includes a regulator casing. The first electrical regulator 80 is configured to include in the regulator casing a servo switching valve 84 for activating the servo mechanism 25, a pilot piston 85 for activating the servo switching valve 84 and a solenoid proportional valve 86 for applying pilot pressure to the pilot piston 85.

The servo switching valve 84 includes a spool 87 and a sleeve 88. The spool 87 is disposed in the regulator casing so as to be able to carry out the reciprocating displacement. The displacement of the spool 87 changes a connection status between a first port 101 which is connectable to the first oil chamber 53 and a second port 102 to which the driving oil is supplied and a connection status between the first port 101 and a drain port 103 connected to a drain. The changing of the connection status activates the servo piston 91 to incline the swash plate 31.

The first port 101, the second port 102 and the drain port 103 are formed on the sleeve 88. The sleeve 88 is coupled to the servo piston 91 by a connecting rod 93, and is disposed in the regulator casing so as to be able to carry out the reciprocating displacement. The sleeve 88 operates in accordance with the displacement of the servo piston 91 or 92 by the connecting rod 93. Opening degrees of the first and second ports 101 and 102 change in accordance with the operation of the sleeve 88. Changing the opening degrees changes the supply status of oil supplied to the first oil chamber 53 of the servo mechanism 25 or 26. The oil is referred to as "mechanism driving oil". The mechanism driving oil corresponds to a mechanism driving fluid. When the servo piston 91 or 92 displaces, and the inclination angle of the swash plate 31 increases excessively, the sleeve 88 controls so as to change the supply status of the mechanism driving oil supplied to the first oil chamber 53 so that the capacity of the pump unit 22 or 23 is reduced.

The pilot piston 85 is disposed to receive the pressure of the pilot oil. The pilot piston 85 displaces the spool 87 to change the connection status of the first port 101 and the second port 102 and the connection status of the first port 101 and the drain port 103 in accordance with the pressure of the pilot oil. An input port 104, an output port 105 and a drain port 106 are formed at the solenoid proportional valve 86. The solenoid proportional valve 86 includes: a valve body 89 which displaces such that the input port 104 or the drain port 106 is connected to the output port 105; and a solenoid 90 to which an electrical signal can be input and which controls pressure of the output port 105 by displacing the valve body 89 in accordance with the input electrical signal. Moreover, the solenoid proportional valve 86 is configured to change the connection status of the output port 105 by displacing the valve body 89 in accordance with the pressure of an output side. A mechanism control valve includes the servo switching valve 84 and the pilot piston 85.

The first electrical regulator 80 is disposed above the first pump unit 22. In the first electrical regulator 80, the solenoid proportional valve 86 that is a solenoid valve changes the supply status of the pilot oil, having been supplied to the input port 104, supplied to the pilot piston 85 in accordance with the input electrical signal. With this, the pilot piston 85 activates, and the spool 87 displaces. The displacement of the spool 87 changes the supply status of the mechanism driving oil supplied to the servo piston 91. With this, the servo piston 91 of the first the servo mechanism 25 activates to incline the swash plate 31 of the first pump unit 22, so that the capacity of the first pump unit 22 is changed.

The second electrical regulator 81 has substantially the same configuration as the first electrical regulator 80 and is disposed above the second pump unit 23. Since the second electrical regulator 81 is similar to the first electrical regulator 80, same reference numbers are used for the same components, and explanations thereof are omitted. As above, the pump equipment 20 is realized such that the first electrical regulator 80 is disposed above the first pump unit 22 of one of two pumps, and the second electrical regulator 81 is disposed above the second pump unit 23 of the other pump.

Figure 2:
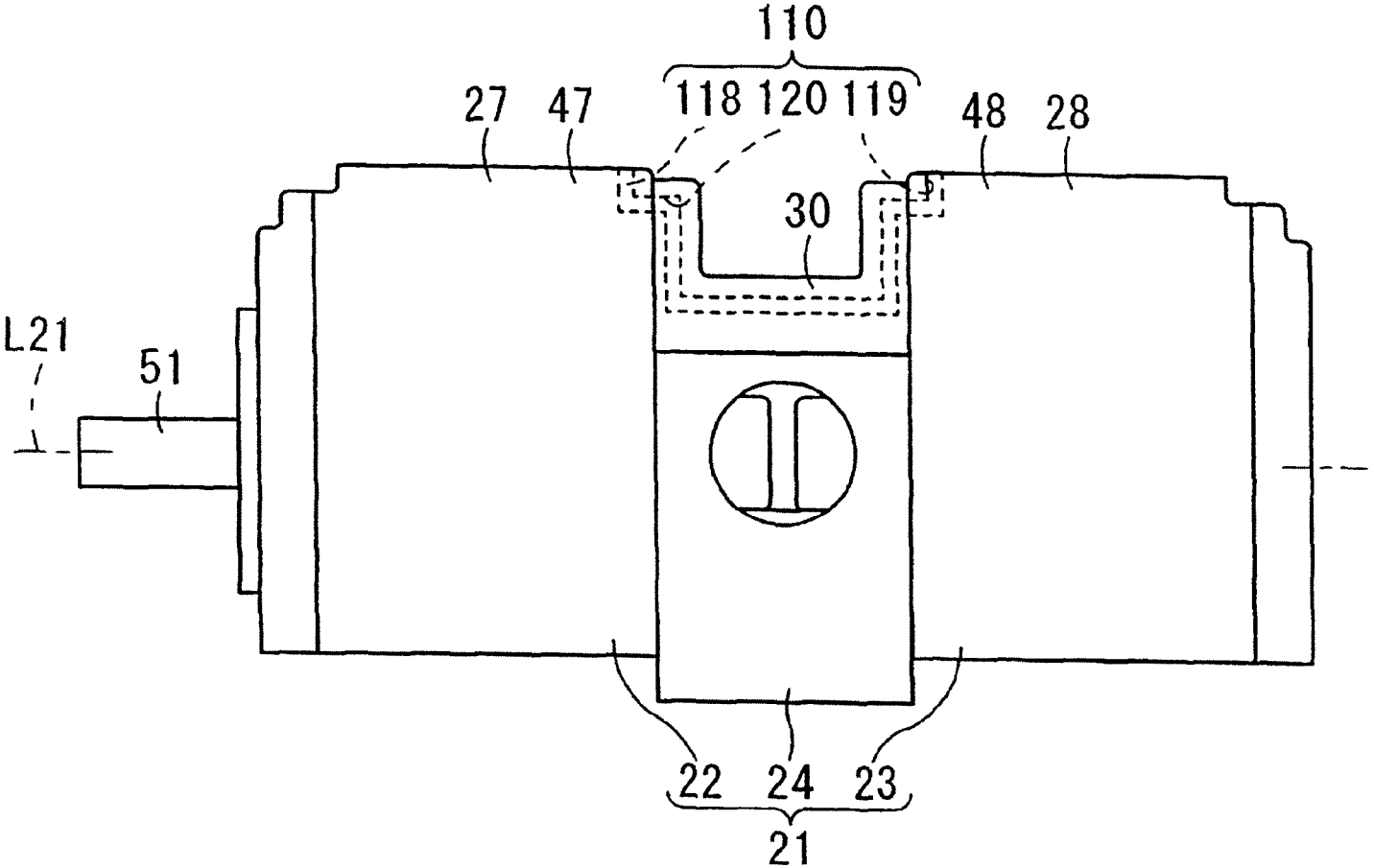
FIG. 2 is a front view schematically showing an inter-pump passage 110 formed in a pump apparatus 21.
Figure 3:
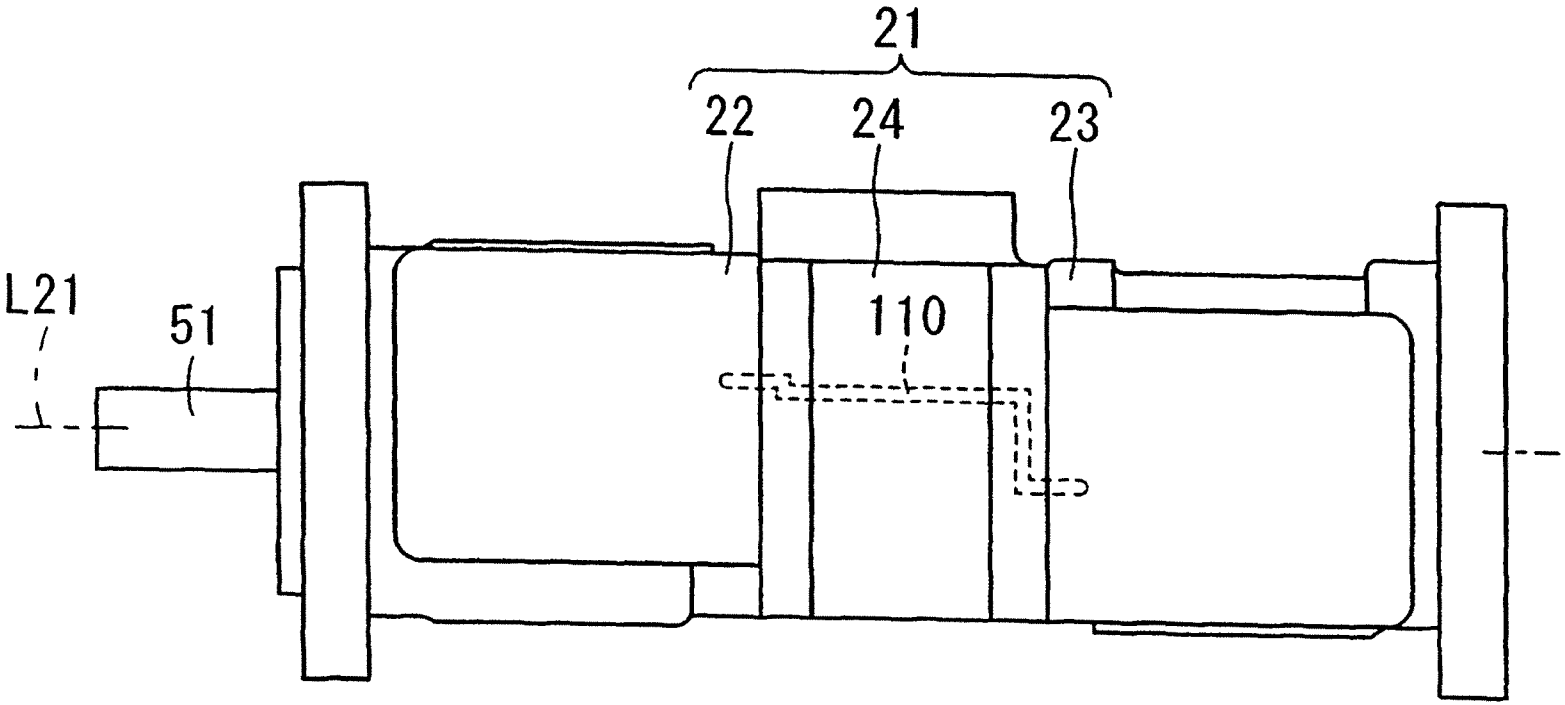
FIG. 3 is a plan view schematically showing the inter-pump passage 110 formed in the pump apparatus 21.
Figure 4:
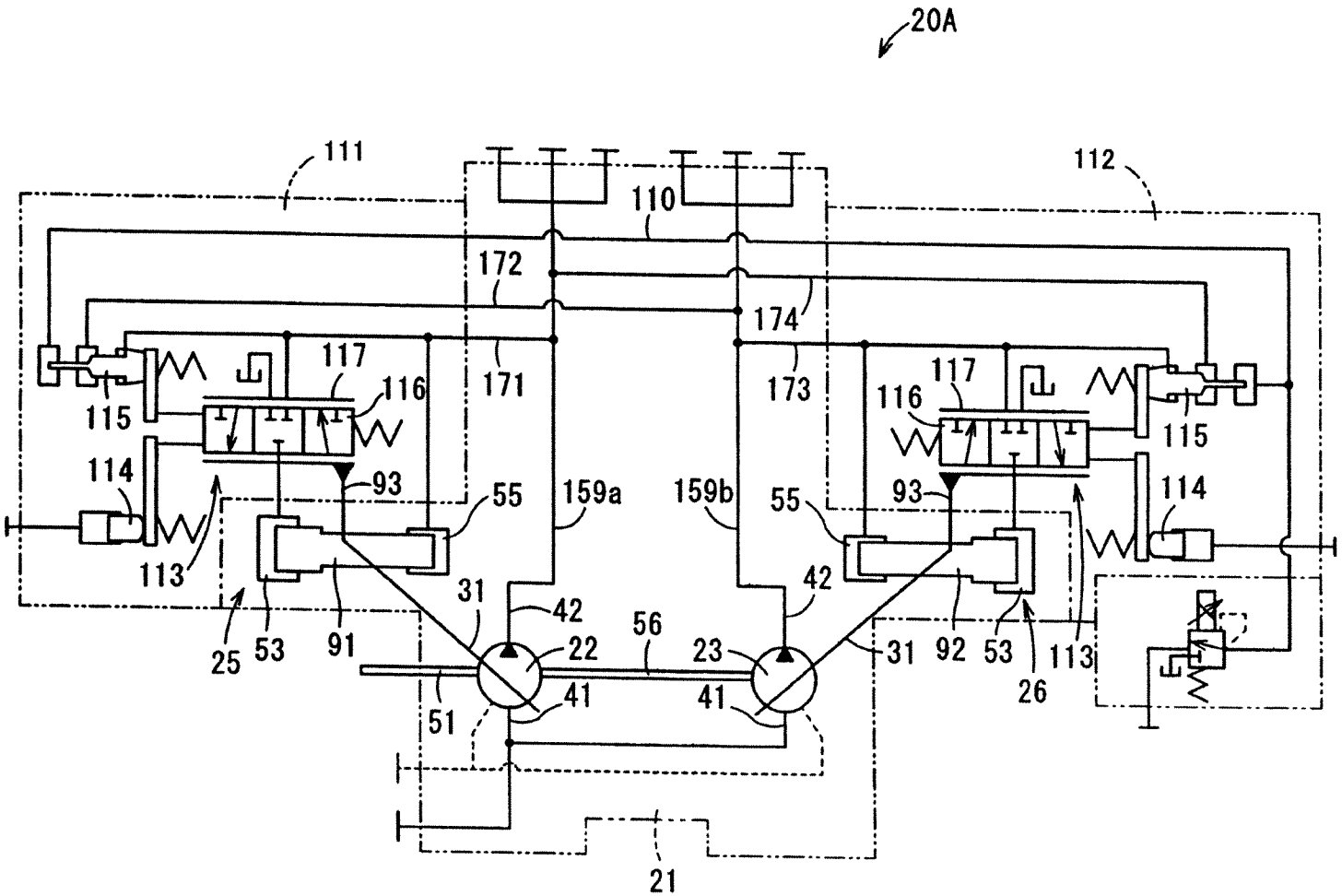
FIG. 4 is a hydraulic circuit diagram showing a hydraulic circuit of a pump equipment 20A including hydraulic regulators 111 and 112.
Figure 5:
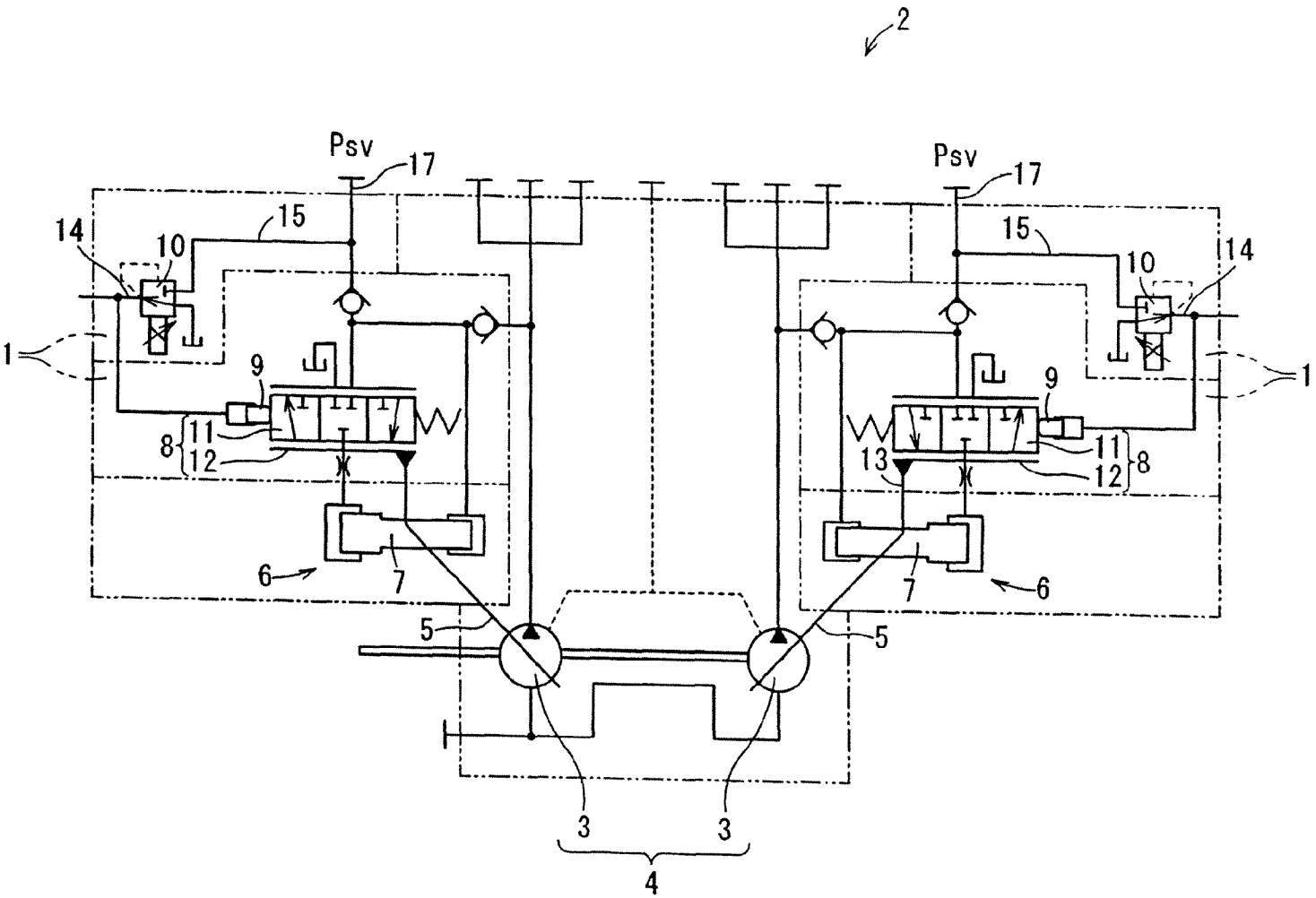
FIG. 5 is a hydraulic circuit diagram showing a hydraulic circuit of a pump equipment 2 including electrical regulators 1 of the first prior art.

FIG. 2 is a front view schematically showing the inter-pump passage 110 formed in the pump apparatus 21. FIG. 3 is a plan view schematically showing the inter-pump passage 110 formed in the pump apparatus 21. FIG. 4 is a hydraulic circuit diagram showing a hydraulic circuit of a pump equipment 20A including first and second hydraulic regulators 111 and 112. Explanations will be made in reference to FIGS. 2 to 4 and FIG. 1. The pump units 22 and 23 can be coupled to the hydraulic regulators 112 and 111, respectively, instead of the electrical regulators 80 and 81 by disposing the hydraulic regulators 112 and 111 above the pump units 23 and 22, respectively. Each of the hydraulic regulators 111 and 112 that are the hydraulic signal input type displacement control devices is a regulator which changes the supply status of the mechanism driving oil supplied to the servo mechanism 26 or 25 in accordance with the pressure of the pilot oil supplied to the hydraulic regulator 111 or 112 to change the capacity of the pump unit 23 or 22.

In place of the first electrical regulator 80, the first hydraulic regulator 111 is disposed above the first pump unit 22. The first hydraulic regulator 111 includes a servo switching valve 113, a pilot piston 114 and a power control piston 115. The servo switching valve 113 includes a spool 116 and a sleeve 117 each of which can carry out the reciprocating displacement. The pilot piston 114 is disposed for the spool 116 to receive the pressure of the supplied pilot oil and to displace the spool 116 in accordance with this pressure. Further, the power control piston 115 is disposed to displace the spool 116 in accordance with the pressure of the hydraulic oil discharged from the first pump unit 22 or the second pump unit 23 and the pressure of the power control piston driving oil supplied thereto. A control piston driving oil corresponds to a hydraulic signal.

The first hydraulic regulator 111 displaces the spool 116 by the pilot piston 114 in accordance with the pressure of the pilot oil supplied to the first hydraulic regulator 111 to change the supply status of the mechanism driving oil supplied to the first oil chamber 53, and thus changes the capacity of the first pump unit 22. Moreover, the first hydraulic regulator 111 changes the capacity of the first pump unit 22 by the power control piston 115 in accordance with the pressure of the hydraulic oil discharged from the first and second pump units 22 and 23 and the pressure of the supplied power control piston driving oil.

The second hydraulic regulator 112 has substantially the same configuration as the first hydraulic regulator 111 and is disposed above the second pump unit 23 in place of the second electrical regulator 81. Since the second hydraulic regulator 112 has substantially the same configuration as the first hydraulic regulator 111, same reference numbers are used for the same components, and explanations thereof are omitted. As with the first hydraulic regulator 111, the second hydraulic regulator 112 drives the pilot piston 114 in accordance with the pressure of the pilot oil supplied to the second hydraulic regulator 112, drives the power control piston 115 in accordance with the pressure of the hydraulic oil discharged from the first and second pump units 22 and 23 and the pressure of the power control piston driving oil to change the capacity of the second pump unit 23. The above two hydraulic regulators 111 and 112 and the pump apparatus 21 forms a hydraulic equipment capable of changing the capacities of the pump units 22 and 23 by the oil pressure.

The pump apparatus 21 includes the inter-pump passage 110 extending over the pump casings 27 and 28 and the valve casing 30. In the case of disposing the hydraulic regulators 111 and 112 for the pump units 22 and 23, the inter-pump passage 110 that is a passage extending between the hydraulic apparatuses is used to direct the supplied power control piston driving oil from the first hydraulic regulator 111 to the second hydraulic regulator 112. Specifically, the inter-pump passage 110 is formed to extend from an upper end portion 47 of the first pump unit 22 through the valve casing 30 to an upper end portion 48 of the second pump unit 23. The inter-pump passage 110 opens at the upper end portions 47 and 48 of the pump units 22 and 23 toward the hydraulic regulators 111 and 112 disposed above the upper end portions 47 and 48 of the pump units 22 and 23. The inter-pump passage 110 includes a pump passage 118 of the pump casing 27, a pump passage 119 of the pump casing 28 and a valve passage 120 of a valve block.

The pump apparatus 21 includes first and second pump side driving oil passages 171 and 173. In the case of using the electrical regulators 80 and 81, the first pump side driving oil passage 171 is used to supply the hydraulic oil, having been discharged from a first discharge passage 159*a*, to the first electrical regulator 80 as the mechanism driving oil. Moreover, in the case of using the hydraulic regulators 111 and 112, the first pump side driving oil passage 171 is used to supply the hydraulic oil, having been discharged from the first discharge passage 159*a*, to the power control piston 115 of the first hydraulic regulator 111. In the case of using the electrical regulators 80 and 81, the second pump side driving oil passage 173 is used to supply the hydraulic oil, having been discharged from a second discharge passage 159*b*, to the second electrical regulator 81 as the mechanism driving oil. Moreover, in the case of using the hydraulic regulators 111 and 112, the second pump side driving oil passage 173 is used to supply the hydraulic oil, having been discharged from the second discharge passage 159*b*, to the power control piston 115 of the second hydraulic regulator 112.

Further, the pump apparatus 21 includes first and second power control oil passages 172 and 174. The first and second power control oil passages 172 and 174 are used in a case where the hydraulic regulators 111 and 112 are disposed for the pump units 22 and 23. The first power control oil passage 172 is used to supply the hydraulic oil, having been discharged from the second discharge passage 159*b*, to the power control piston 115 of the first hydraulic regulator 111. The second power control oil passage 174 is used to supply the hydraulic oil, having been discharged from the first discharge passage 159*a*, to the power control piston 115 of the second hydraulic regulator 112.

A plurality of oil passages are formed in the electrical regulators 80 and 81. Specifically, formed are a driving oil passage 210 connecting the input port 104 and the inter-pump passage 110, an inter-port connection passage 211 connecting the input port 104 and the second port 102, a drain passage 212 connecting the drain port 103 and an accommodating space to direct the hydraulic fluid to the drain, a first oil chamber supply passage 213 connecting the first port 101 and the first oil chamber 53, a regulator side driving oil passage 214 connecting the second port 102 and the pump side driving oil passage 171 or 173, and the second oil chamber 55 connecting the regulator side driving oil passage 214 and a second oil chamber passage 125. The driving oil passage 210 corresponds to a valve driving oil passage 210.

On the inter-port connection passage 211, a check valve 216 is disposed to prevent the driving oil from flowing backward from the second port 102 to the input port 104. A throttle valve 217 is disposed on the first oil chamber supply passage 213. The displacement of the sleeve 88 changes the opening degree of the first port 101 with respect to the first oil chamber supply passage 213. A check valve 218 is disposed on the regulator side driving oil passage 214.

The driving oil that is a valve driving fluid is supplied to the input port 104 of the first electrical regulator 80 by using a hydraulic supply source, such as a gear pump. The supply status of the supplied driving oil, such as the pressure of the supplied driving oil, is changed by the solenoid proportional valve 86 in accordance with an input electrical signal, and the driving oil is supplied to the pilot piston 85 through a pilot passage 105. The driving oil supplied to the pilot piston 85 is the pilot oil. The pilot oil corresponds to the valve driving fluid. The pilot piston 85 is activated in accordance with the supply status of the pilot oil to activate the spool 87.

Moreover, when the discharge pressure of the pump unit 22 is lower than that of the input port 104, the driving oil supplied to the input port 104 of the first electrical regulator 80 is directed to the second port 102 through the inter-port connection passage 211. When the discharge pressure of the pump unit 22 is higher than that of the input port 104, the driving oil is directed from the outlet port 42 of the first pump unit 22 through the first regulator side driving oil passage 214 to the second port 102. The driving oil is directed to the first port 101, when the pilot piston 85 activates the spool 87 to connect the second port 102 and the first port 101. Moreover, the supply of the driving oil to the first port 101 stops, when the spool 87 is activated to connect the first port 101 and the drain port 103 and disconnect the first port 101 and the second port 102. As above, the supply status of the driving oil supplied to the first port 101 is changed by the spool 87 and the sleeve 88. The driving oil having been directed to the first port 101 is supplied to the first oil chamber 53 through the first oil chamber supply passage 213. The driving oil supplied to the first oil chamber 53 by changing the supply status by the servo switching valve 84 is mechanism driving oil. The mechanism driving oil is directed to the drain, when the spool 87 disconnects the second port 102 and the first port 101 and connects the first port 101 and the drain port 103.

The driving oil having been directed through the regulator side driving oil passage 214 is directed to the second oil chamber 55 through a second oil chamber supply passage 215 and the second oil chamber passage 125. In accordance with the pressure of the driving oil directed to the second oil chamber 55 and the pressure of the mechanism driving oil supplied to the first oil chamber 53, the servo piston 91 activates to change the capacity of the first pump unit 22. Moreover, the capacity of the pump unit 22 is determined based on relative positions of the spool 87 and the sleeve 88.

Further, the driving oil having been supplied to the input port 104 of the first electrical regulator 80 is directed to the driving oil passage 210 of the second electrical regulator 81 through the driving oil passage 210 of the first electrical regulator 80 and the inter-pump passage 110, and is then supplied to the input port 104 of the second electrical regulator 81. As with the first electrical regulator 80, the driving oil having a higher one of the pressure of the driving oil supplied to the input port 104 of the second electrical regulator 81 and the pressure of the driving oil directed from the outlet port 42 of the second pump unit 23 is directed to the second port, and the servo piston activates to change the capacity of the second pump unit 23. Thus, the driving oil having been supplied to the first electrical regulator 80 is directed to the second pump unit 23 to change the capacity of the pump unit 23.

Effects obtained by the pump equipment 20 configured as above will be explained. According to the electrical regulators 80 and 81 of the present embodiment, the solenoid proportional valve 86 changes the supply status of the driving oil supplied to the pilot piston 85 in response to the electrical signal input thereto. The servo switching valve 84 controls the supply status of the mechanism driving oil supplied to the servo mechanism 25 or 26 in accordance with the supply status of the driving oil supplied to the pilot piston 85 and activates the servo piston 91 or 92. The capacity of the pump unit 22 can be changed by activating the servo piston 91, and the capacity of the pump unit 23 can be changed by activating the servo piston 92. Since the inter-pump passage 110 extending between the pump units 22 and 23 and the driving oil passage 210 are connected to each other, the driving oil is supplied to the input port 104 of the solenoid proportional valve 86 of the second electrical regulator 81 by supplying the driving oil to the solenoid proportional valve 86 of the first electrical regulator 80. Therefore, a pipe for supplying the driving oil does not have to be additionally formed for each of the input ports 104 of the first and second solenoid proportional valves 86. On this account, in the case of disposing the pump equipment 20, it is possible to reduce the pipes to be disposed on the pump equipment 20. Thus, it is possible to reduce the space necessary for disposing the pipes as compared with the first prior art. With this, it is possible to reduce the occupied space of the pump equipment 20. Since it is possible to omit steps of disposing the pipes when mounting the pump equipment 20 on, for example, an industrial machinery, it is possible to reduce the number of operation steps.

According to the electrical regulators 80 and 81 of the present embodiment, in the case of using the hydraulic regulators 111 and 112 instead of the electrical regulators 80 and 81, the inter-pump passage 110 formed in the pump apparatus 21 is used to direct the fluid pressure, which is used to control the capacities of the pump units 22 and 23, from the first hydraulic regulator 111 to the second hydraulic regulator 112. The inter-pump passage 110 is not used in the case of using the electrical regulators 1 of the prior art. The inter-pump passage 110 formed in the pump apparatus 21 can be utilized effectively in the case of using the electrical regulators 80 and 81 of the present embodiment. Moreover, in the case of the pump apparatus 21 capable of activating the servo mechanisms 25 and 26 by the hydraulic regulators 111 and 112, it is unnecessary to additionally form the inter-pump passage 110, and it is possible to omit steps of forming the inter-pump passage 110. Therefore, in the case of the pump apparatus 21 for which the hydraulic regulators 111 and 112 can be disposed, the electrical regulators 80 and 81 can be disposed without additionally forming the inter-pump passage 110 and are high in versatility.

According to the pump equipment 20 of one embodiment of the present invention, by supplying the driving oil to the first electrical regulator 80, the capacities of the pump units 22 and 23 can be changed in accordance with the electrical signals input to the first and second electrical regulators 80 and 81. Therefore, the pipe for supplying the driving oil does not have to be additionally formed for each input port 104 of the solenoid proportional valve 86. On this account, in the case of disposing the pump equipment 20, it is possible to reduce the pipes to be disposed on the pump equipment 20. Thus, it is possible to reduce the space necessary for disposing the pipes as compared with the second prior art. Therefore, it is possible to reduce the occupied space of the pump equipment 2 in industrial machineries and construction machineries. As above, since the existing inter-pump passage 110 can be utilized effectively, the cost effectiveness of the pump equipment 20 can be improved.

Moreover, according to the electrical regulators 80 and 81 of the present embodiment, it is possible to effectively utilize the oil passages formed in the pump units 22 and 23 used for the hydraulic regulators 111 and 112. Therefore, it is unnecessary to additionally form the oil passages in the pump units 22 and 23 to use the electrical regulators 80 and 81, and also possible to reduce the number of operation steps.

In the present invention, respective components in the electrical regulators 80 and 81 are not limited to these, and any components may be used as long as the input port 104 is connected to the inter-pump passage 110 via the driving oil passage 210. Moreover, the inter-pump passage 110 is not limited to a passage which can be shared between the hydraulic regulators 111 and 112 and the electrical regulators 80 and 81, and may be formed only for use in the electrical regulators 80 and 81.

The invention claimed is:

1. A pump equipment comprising:

a pair of pump units, each of the pump units including a swash plate type piston pump and a capacity changing mechanism configured to incline a swash plate of the swash plate type piston pump to change a pump capacity;

a valve unit sandwiched between the pair of pump units, the valve unit coupled to the pair of pump units; and a pair of electrical regulators, each of the electrical regulators including a mechanism control valve and a solenoid proportional valve and coupled to a respective one of the pair of pump units, each mechanism control valve being configured to control a mechanism driving fluid introduced to the capacity changing mechanism, the solenoid proportional valve being configured to reduce pressure of an input port in accordance with an input electrical signal and introduce the pressure as pilot pressure to a pressure receiving portion of the mechanism control valve, wherein:

an inter-pump passage extends between the pair of pump units, the inter-pump passage including a pump passage formed in each of the pair of pump units and a valve passage formed at a valve block of the valve unit; and wherein the inter-pump passage opens at the pair of pump units toward the electrical regulators, and wherein primary ports of the solenoid proportional valves of the pair of pump units communicate with each other through the inter-pump passage.

* * * * *

UNITED STATES PATENT AND TRADEMARK OFFICE

CERTIFICATE OF CORRECTION

PATENT NO. : 8,562,307 B2
APPLICATION NO. : 12/162117
DATED : October 22, 2013
INVENTOR(S) : Shimazaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1215 days.

Signed and Sealed this
Fifteenth Day of September, 2015

Michelle K. Lee

Michelle K. Lee
*Director of the United States Patent and Trademark Office*